US006260695B1

(12) United States Patent
Tasber et al.

(10) Patent No.: US 6,260,695 B1
(45) Date of Patent: Jul. 17, 2001

(54) SYSTEM FOR PACKAGING AND DISPENSING DRY CONTACT LENSES

(75) Inventors: Frank Tasber, Henrietta; Dominic V. Ruscio, Webster, both of NY (US); Makarand G. Joshi, Pluckemin, NJ (US)

(73) Assignee: Bausch & Lomb Incorporated, Rochester, NY (US)

( * ) Notice: Subject to any disclaimer, the term of this patent is extended or adjusted under 35 U.S.C. 154(b) by 0 days.

(21) Appl. No.: 09/589,831

(22) Filed: Jun. 8, 2000

Related U.S. Application Data

(60) Provisional application No. 60/138,732, filed on Jun. 11, 1999.

(51) Int. Cl.[7] ..... A45C 11/04

(52) U.S. Cl. ..... 206/5.1; 206/499; 53/475; 221/211

(58) Field of Search ..... 206/5.1, 499, 817; 53/510, 409, 432, 468, 475; 134/901; 294/1.2, 64.1; 221/296, 210, 211, 198, 226, 231

(56) References Cited

U.S. PATENT DOCUMENTS

| | | | | |
|---|---|---|---|---|
| 3,089,500 | | 5/1963 | Stalcup . | |
| 3,966,076 | | 6/1976 | Kroger et al. . | |
| 4,054,624 | | 10/1977 | LeBoeuf et al. . | |
| 4,574,944 | | 3/1986 | Gregory . | |
| 4,782,946 | | 11/1988 | Pollack . | |
| 4,826,012 | * | 5/1989 | Kosanovich | 206/499 |
| 4,909,382 | | 3/1990 | Cuppari . | |
| 4,925,017 | | 5/1990 | Jessen . | |
| 5,141,678 | | 8/1992 | Blum . | |
| 5,476,111 | | 12/1995 | Andersen et al. . | |
| 5,534,224 | * | 7/1996 | Abe | 221/198 |
| 5,615,767 | * | 4/1997 | Eull et al. | 206/499 |
| 5,657,506 | * | 8/1997 | Pankow | 206/5.1 |
| 5,741,535 | * | 4/1998 | Cope et al. | 206/499 |
| 5,881,877 | * | 3/1999 | Adams | 206/499 |

FOREIGN PATENT DOCUMENTS

| | | |
|---|---|---|
| 2 328 924A | 3/1999 | (GB) . |
| WO 92/05754 | 4/1992 | (WO) . |

* cited by examiner

*Primary Examiner*—Luan K. Bui
(74) *Attorney, Agent, or Firm*—Robert B. Furr, Jr.

(57) ABSTRACT

This invention relates to the packaging or dispensing of hydrogel contact lenses in a dry state. By packaging hydrogel lenses dry, the risk of bacterial growth and package or product degradation commonly associated with hydrated lenses is reduced or eliminated, thereby significantly extending product shelf life. The application of a material or the placement of a divider between unhydrated lenses prevents the lenses from adhering to each other and allows manufacturers to package lenses in more space-efficient packaging. Such a packaging and dispensing system dramatically simplifies and reduces the cost of manufacturing, storing, packaging, inventorying, and distributing hydrogel contact lenses.

44 Claims, 6 Drawing Sheets

SYSTEM FOR PACKAGING AND DISPENSING DRY CONTACT LENSES

This application claims the benefit of U.S. Provisional application Serial No. 60/138,732, filed Jun. 11, 1999.

TECHNICAL FIELD

This invention relates to the packaging and dispensing of contact lenses. In particular, the invention involves the packaging and/or dispensing of soft contact lenses in an unhydrated state, for either manufacturing purposes or customer use.

BACKGROUND

Soft contact lenses that are hydrophilic and form hydrogels when hydrated (hereinafter referred to as hydrogel lenses) are typically sold already hydrated for several reasons. Lenses already hydrated and, therefore, packaged in solution can be immediately worn upon purchase, by merely removing the lens from the package, without any subsequent treatment of the lens or additional preparation by the consumer. Lenses have already acquired their desired shape for use in the hydrated form and can, therefore, comfortably fit on a patient's eyes. In contrast, a hydrogel contact lens, in the dry state, cannot be safely or comfortably placed on the eye and must first be hydrated prior to being worn by the customer.

While consumers may enjoy the convenience of ready-to-wear lenses directly out of their package, several disadvantages and costs are associated with such hydrated lenses. It can be recognized that a large percentage of total lens cost is attributable to the cost of hydrating, packaging, and sterilizing such lenses. Lenses have traditionally been wet packaged in vials or, more commonly, blister packs. In either case, the addition of hydrating solution adds to the overall weight and volume of the finished product and increases shipping and storage costs. When blister packs are used, they are sealed with lid stock made of plastic and aluminum to prevent the hydrating solution from escaping. The use of lid stock further increases the cost of packaging hydrated lenses.

Another disadvantage of manufacturing and packaging a hydrated lens is that the hydrating solution not only complicates the packaging, but creates an environment that is potentially susceptible to bacterial growth. Furthermore, the hydration and sterilization of the lenses can make them more susceptible to hydrolysis or degradation. (The shelf life of a particular lens can vary depending upon its composition, porosity, rigidity, thickness, etc.) Also, the saline solution used in packaging contains salt that is aggressive towards lid-stock packaging and can, therefore limit the shelf life not only of the lens itself but the blister packs used to contain them. Of course, the integrity of the package cannot be compromised without jeopardizing the sterility of the hydrated lens. Thus, the risk of package degradation and bacterial growth can limit the shelf life of hydrated lenses.

The vulnerability of hydrated lenses and/or their package to gradual degradation, with consequent bacterial growth on the lens, thus makes it necessary for manufacturers to include an expiration date with each pair of contact lenses. Typically, the shelf life for wet-packaged contact lenses ranges from two to five years, often only a couple years, commencing from the time the lenses are autoclaved.

Lenses hydrated and packaged in solution must be sterilized. Sterilization of the hydrated lens during manufacturing and packaging is typically accomplished by autoclaving.

The autoclaving process involves heating the lens to a temperature of about 121° C. for approximately 20 minutes under pressure. As mentioned above, such treatment may adversely affect the shelf life of the lens. By exposing lenses to high temperatures during autoclaving, polymeric bonds can be weakened or hydrolyzed, accelerating polymer degradation. Furthermore, autoclaving adds additional time and cost to the manufacturing process. Each batch of sterilized lenses may be quarantined while the effectiveness of the sterilization process is tested and confirmed. Also, autoclaving, associated with the packaging of hydrated lenses, has the disadvantage that it can potentially increase lens extractables from the lens or adversely affect the surface treatments or coatings existing on some kinds of lenses.

Even after the manufacture of the lens is complete, the hydration of hydrogel lenses incurs associated costs. Additional volume is needed for maintaining the lens in hydrated form, which can significantly add to the cost of storing, inventorying, and distributing the lenses to the retailer or customer. Furthermore, the above-mentioned limited shelf life associated with hydrated lenses can also add to the cost of storing, inventorying, and distributing the lens, not to mention the increased likelihood that the customer may need to discard expired lenses before they are worn. The limited shelf life of hydrated lenses adds to the difficulty of inventorying such lenses because manufacturers must anticipate the demand for each type of lens and then compare the demand with the existing supply. In doing so, they must also consider the remaining shelf life of stored lenses. Doctors face similar difficulties when purchasing lenses to meet their patients' needs. Unfortunately, consumer demand cannot be determined with certainty. Therefore, the anticipated demand can exceed the actual demand and can result in significant obsolescence costs.

Packaging systems and dispensing systems according to Applicants' invention offer manufacturers a simplified, more cost-effective way to manufacture, store, inventory, and distribute hydrogel contact lenses.

SUMMARY OF THE INVENTION

Applicants have invented a system to package or contain and then dispense dry (unhydrated) hydrogel contact lenses. A prearranged supply of lenses can be contained within a single container (for manufacturing use) or package (for customer use) by employing a means to limit or prevent physical contact between adjacent lenses, using either a powdered material, a coating material, or one or more dividers separate from or integral with the container that can comprise a sheet, a wall, a shelf, a bar, or the like to at least partially separate adjacent lenses and/or limit the space in which a lens can move within the container.

The lenses are preferably arranged in the package in a manner that is space efficient. In one preferred embodiment, therefore, the lenses are positioned in a stacked array so that each lens is nested one into the other to effectively reduce or minimize the space between lenses. Applicants place at least one first lens between a second and third lens so that the anterior side of the first lens is adjacent to the posterior surface of the second lens and a posterior surface of the first lens is adjacent to the anterior surface of the third lens.

A prearranged supply of three or more unhydrated hydrogel lenses can thus be packaged in a single container, wherein the supply of lenses are all commonly exposed to the internal atmosphere of the container, that is, the lenses are not sealed off from each other. Since it may be convenient to sell supplies of lenses for one-week, two-week, or one-month periods, each stacked array in a single container can conveniently include from 7 to 29–31 lenses or more. For instance, a stacked array can comprise sufficient daily wear lenses for a week (7 lenses), two weeks (14 lenses), or a month (29–31 lenses). Alternately, for example, a stacked array can comprise sufficient one-week-wear lenses for a month (4 lenses).

Unhydrated lenses can have a tendency to adhere to each other, especially in the presence of a relatively high ambient humidity and/or when there is intimate contact between lenses over a significant surface area. To avoid this problem, Applicants place a material or device between the lenses limiting the physical contact between adjacent lenses. In one embodiment, Applicants prefer to apply a non-toxic powder to the lenses during packaging to keep the surfaces of the lenses spaced slightly apart, not touching. In view of the susceptibility of the eye to infection, irritation, or injury from particulate matter, the particular powder selected for dry packaging preferably has several characteristics. First, to reduce the possibility of bacteria growing on the powdered lens, Applicants prefer to use a powder that is incapable of supporting bacterial growth. More specifically, Applicants prefer a powder with a chemical structure that is resistant to both chemical and enzymatic attack. Furthermore, to avoid irritating or injuring the eye with particulate matter, Applicants prefer to use a fine, highly water-soluble powder so that, when the lenses are hydrated before use, any residual powder is dissolved. In addition, the powder preferably exhibits low water uptake from ambient air to avoid caking during storage (for example, after the container holding a plurality of lenses is first opened).

Alternatively to a powder, physical contact between lenses can be limited or prevented by configuring the container to include dividers (for example, but not limited to, shelves, bars, walls, or portions therefore) between adjacent lenses in order to prevent or reduce physical contact between adjacent lenses. The dividers can be included as part of the container (for example, a cylindrical container can have shelves or walls spaced along and substantially perpendicular to the longitudinal axis of the container). Dividers can be in the shape of annular rings, circular segments, bars, prongs, etc.

Applicants' packaging system can optionally be used in combination with a container or dispenser, respectively, to remove unhydrated lenses for hydration, respectively, by the manufacturer or by the customer (lens wearer). For instance, one embodiment of a dispenser employs suction to lift lenses from their container or dispenser. Another embodiment employs adhesion, with a wetted extraction member and a rotating holder, to lift the lenses from their container. Once a lens is removed from the container either through suction, adhesion, or both, the dispensing device can use gravity, air pressure, or both to release the lens into a lens holder or lens case where it can be hydrated and stored. In yet another embodiment of a dispenser, the dispenser is designed to be used in conjunction with a supply of lenses in a shelved storage container. More specifically, the dispensing system involves two slidably concentric cylinders wherein incremental reverse telescoping of the inner cylinder is employed to bend lens shelves along the axis of the outer cylinder (the original container for the supply of lenses) so that the lenses fall from the outer cylinder (container) one at a time into a lens holder or case for hydration and storage as the inner cylinder bends each divider/support for the bottom remaining lens. In a further embodiment, a dispenser that is designed to be used in conjunction with a stacked array of lenses separated by a powder comprises a piston at the bottom of the lens container or package to sequentially advance the lenses towards the opening of the container.

The advantages of the lens packaging, storing, and/or dispensing systems according to the present invention include more economical manufacture, space-efficient packaging, lenses with extended shelf life, and decreased costs associated with the storage, inventorying, distribution, and shipping of lenses.

DRAWINGS

Figure 5B:
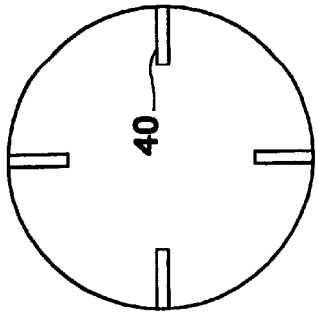
Figure 5A:
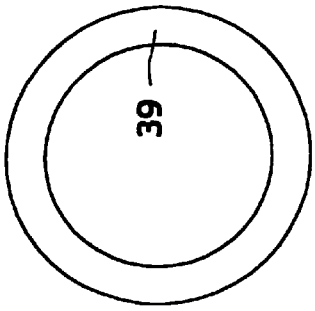
Figure 5C:
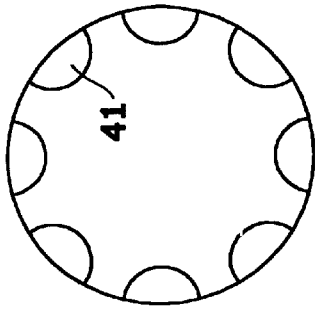
Figure 6:
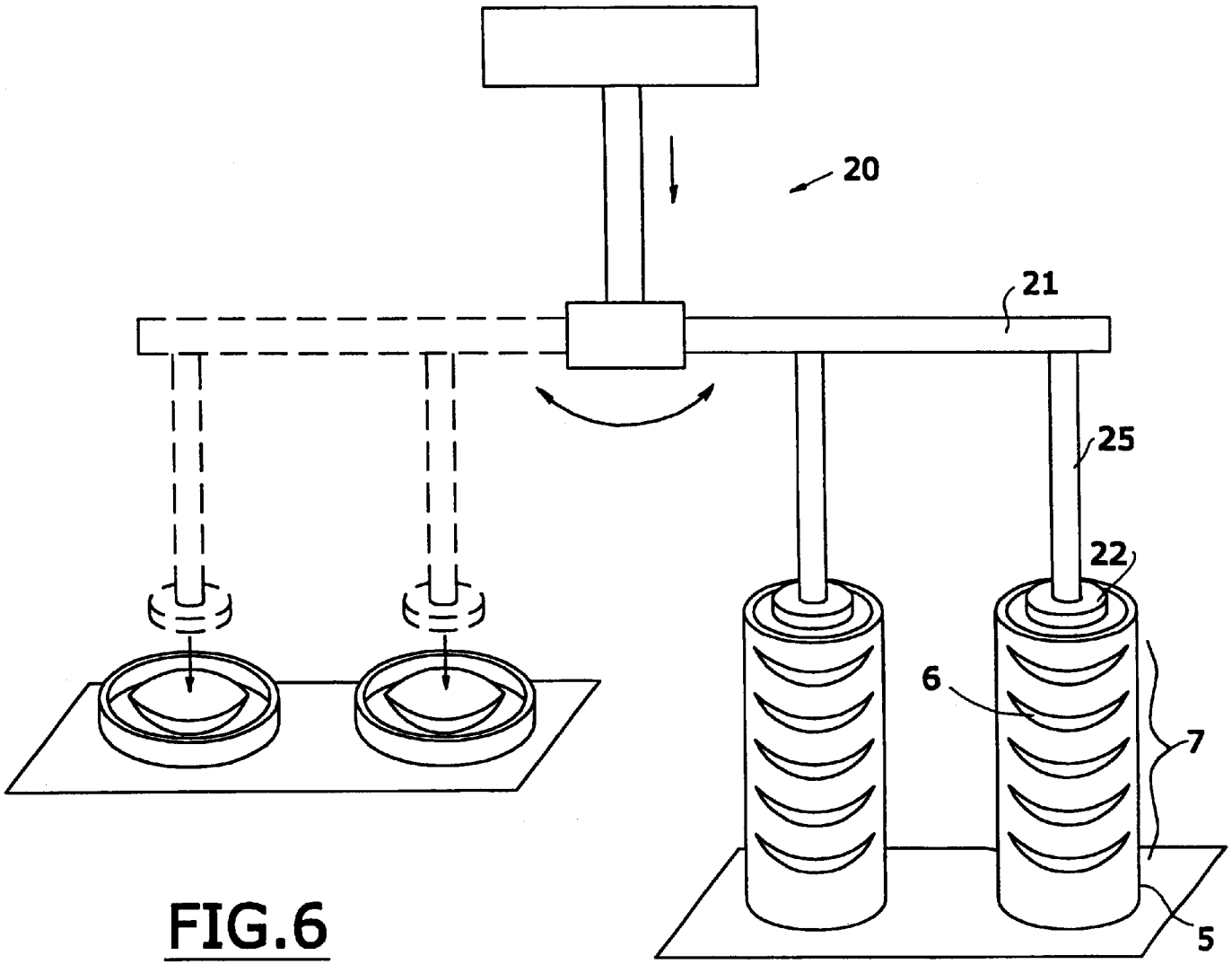

FIGS. 5A, 5B, and 5C are schematic views of various embodiments for dividing and/or supporting contact lenses in the container of FIG. 6, including respectively an annular shelf, prongs, bars, and circular segments.

FIG. 6 is a schematic view of one embodiment dispenser systems according to the present invention comprising a movable member for transporting a lens by suction.

Figure 7:
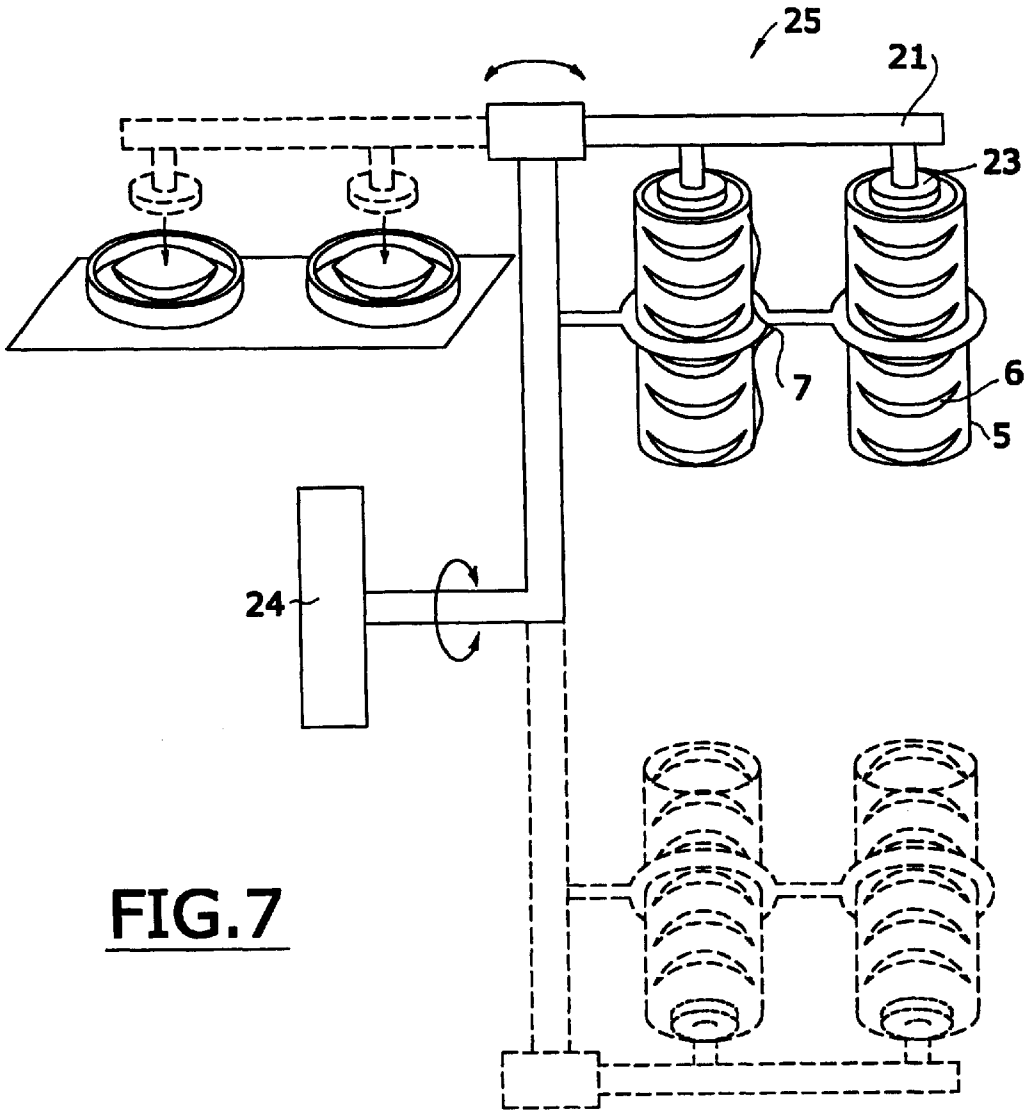

FIG. 7 is a schematic view of another embodiment of a dispenser system comprising a moveable member for transporting a lens by wet adhesion.

Figure 8:
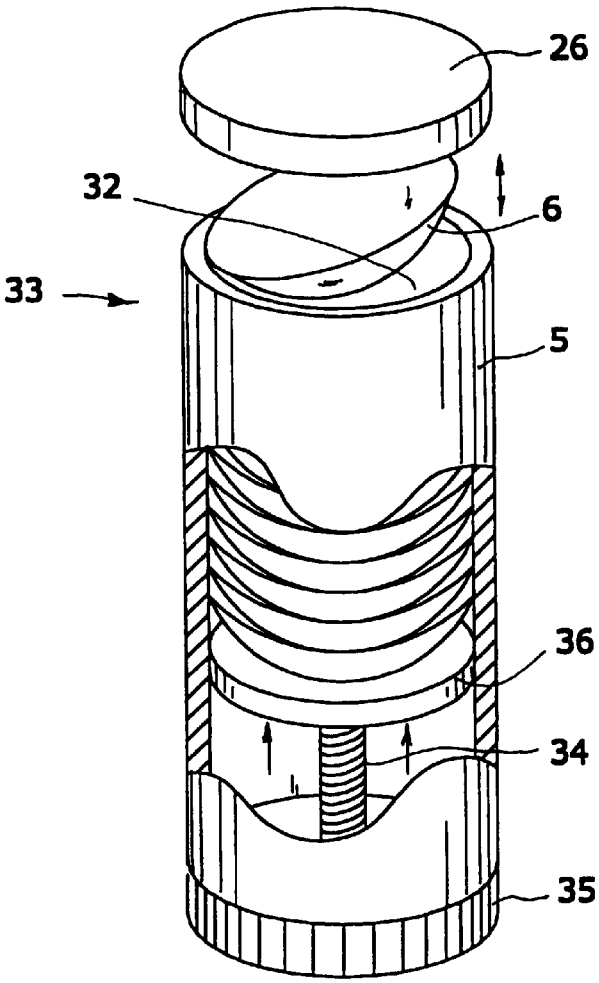

FIG. 8 is a partial cut-away view of another embodiment of a lens dispensing packaging system comprising a stacked lens wherein the top of the remaining lenses can be moved to the opening of the container by means of an incrementally moveable (screw-type) piston at the bottom of the container.

Figure 9:
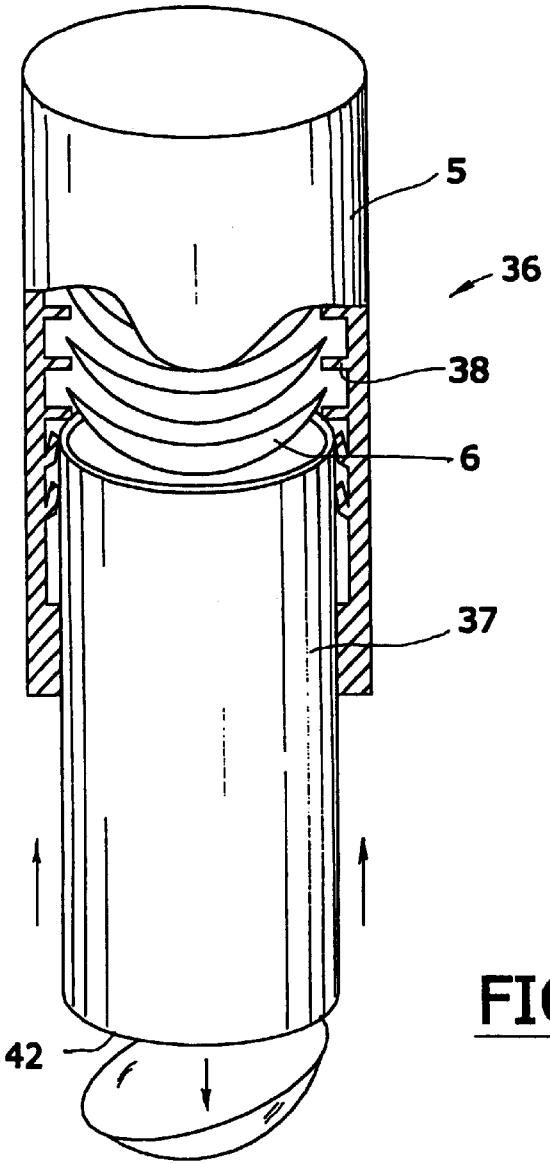

FIG. 9 is a schematic view of another embodiment of a means for dispensing contact lenses, in this case from a shelved storage container by reverse telescoping two cylinders.

DETAILED DESCRIPTION

Applicants have recognized the problems and costs associated with manufacturing, storing, inventorying, and distributing hydrated lenses. To eliminate or significantly reduce these problems and costs, Applicants have developed a system for dry packaging hydrogel contact lenses.

Figure 1:
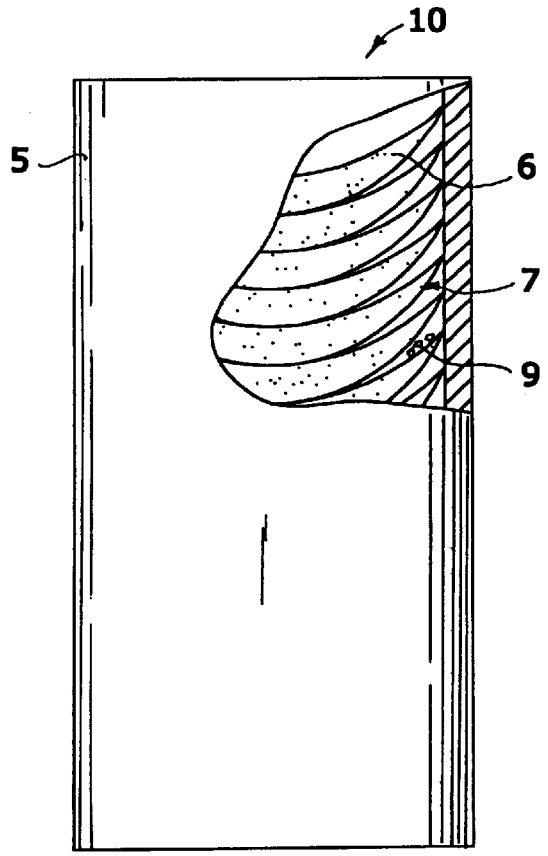
FIG. 1 is a partial cut-away view of one embodiment of a supply of contact lenses stored within a cylindrical lens storage container or package.

FIG. 1 shows one embodiment of a system 10 for dry packaging hydrogel contact lenses in a storage container 5. The lenses 6 are arranged in a stack 7 wherein anterior surfaces are nested in posterior surfaces. By nesting the lenses 6, the space between lenses and the space occupied by the stack 7 are effectively minimized. This, in turn, minimizes storage and shipping costs.

The packaging system 10 of FIG. 1 employs a powdered material 9 placed on the lenses and therefore positioned between adjacent lenses 6 to reduce physical contact and prevent sticking. Many different materials can be used to limit the contact between lenses 6, including plastic or wax coatings, sheets of paper or plastic, talc powder, polymeric or cellulose particles, etc. Applicants prefer to dust the lenses with a fine powder 9. More specifically, Applicants prefer to use a cyclodextrin powder, since it is highly water-soluble. A powder that is water soluble is important in order to ensure that any residual material, particulate matter left on the lens 6, is dissolved when the lens 6 is hydrated before placement on the eye. Preferably, the powder has a chemical structure that resists enzymatic attack, thereby preventing or not supporting bacterial growth. Preferably also, the powder is relatively non-hygroscopic powder, such that water uptake is prevented. For example, cyclodextrin is non-toxic and exhibits low water uptake, preventing the powder from caking during storage.

For consumer use, the lens packaging system of FIG. 1 includes a short-term supply of lenses 6 in an evacuated, hermetically sealed container 5. To prevent the lenses 6 from adhering when the package is opened and the lenses are exposed to moisture, consumers can be instructed to hydrate the supply of lenses 6, all at once or within a limited period of time. Consumers could then purchase several one-week packages and, at the beginning of each week, open a package and hydrate the lenses, providing a week's supply of lenses that are ready to wear. In the meantime, the unopened packages could remain on-hand for an extended period of time, since lenses in their dry state have an extended shelf life in which expiration dates are prolonged, vis-à-vis lenses packaged in a hydrated state.

The storage container 5 in FIG. 1 is cylindrical in shape with a diameter slightly larger than the diameter of the lenses 6. Such a cylindrical storage container 5 provides space efficiency, limiting the free space between the lenses 6 and the storage container 5. Furthermore, by sizing the container 5 so that it is only slightly larger than the lenses 6 to be stored within it, the lenses 6 are prevented from flipping over inside the container 5. The length of each container 5 can vary depending on its intended use. For instance, the container 5 might be provided to consumers for home use, or alternatively it might be supplied to eye-care practitioners for office use. The length of the container 5 can be appropriately designed for its intended environment of use. For instance, the length of a container intended for professional use might be substantially greater than the length of a container intended for home use, since a greater number of lenses may be needed over time for practitioner use. In addition to customer or practitioner use, the container 5 may also be configured for manufacturing purposes. In this case, the container 5 can be several feet long so that it can accommodate an even larger supply of lenses to be stored to await distribution or packaging, even packaging at a distribution site in a hydrated form before being distributed to the customer. Such a scenario can be particularly advantageous for the distribution of lenses to various countries, for example, where the ambient temperature is relatively high or where manufacturing sites do not exist. Thus, the distribution of dry lenses to distribution centers can even reduce the number of lens manufacturing sites that are needed on a global basis.

Since moisture can cause stacked lenses to adhere, the introduction of moisture into the container, before the lenses are all dispensed, is preferably avoided. In the case of a storage container for manufacturing use, manufacturers can design the container to prevent or minimize the introduction of water vapor during lens dispensing. This can be accomplished by having a re-sealable opening. In one embodiment (not shown), the opening of the container comprises a flexible, slitted member capable of opening and closing to allow for the removal or release of a single lens while simultaneously limiting the amount of moisture that can be introduced into the container. Alternately, the opening of the storage container can be surrounded by an inert gas during the dispensing operation.

Particularly with respect to use in manufacturing, an alternative to the embodiment shown in FIG. 1 is to package the lenses in their dry state in the absence of a powder or other comparable material for limiting contact between lenses. In this capacity, the lenses 6 would retain an extended shelf life and could be stored for longer periods of time. Upon sale or distribution, the manufacturer, at the plant or at a remote site, could then hydrate the lenses 6, preparing them to be packaged for direct wear by the consumer. In this embodiment, the lenses are preferably packaged in an evacuated, hermetically sealed, gas and liquid impermeable storage container. By evacuating and sealing the container, water vapor is eliminated and the lenses are prevented from sticking together. In addition to, or instead of maintaining a vacuum to prevent the lenses from sticking, one can also maintain an inert or dry atmosphere within the container. Since the lenses can be exposed to humidity when the sealed container is opened, the lenses preferably should be hydrated shortly thereafter. A desiccant within the container can be used in this embodiment to maintain a humidity free internal atmosphere, thereby further avoiding moisture causing the lenses to adhere to one another.

Figure 2:
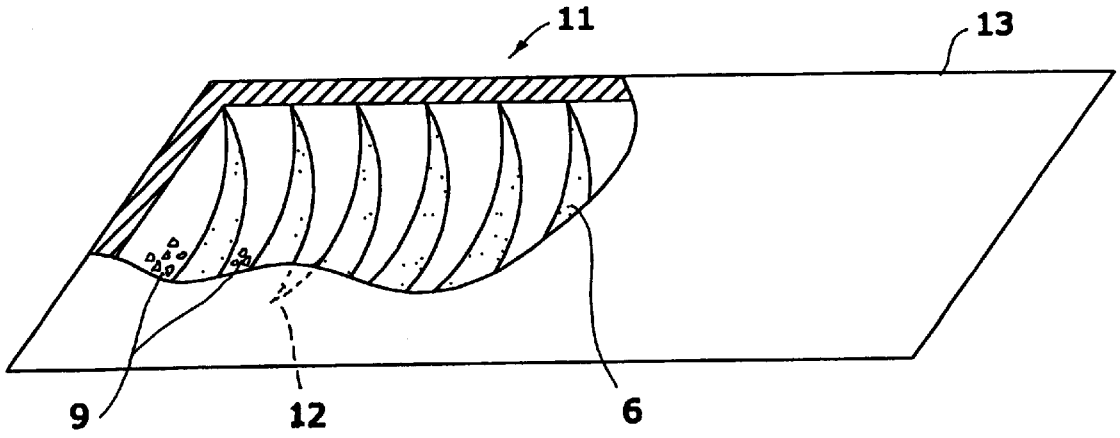
FIG. 2 is a partial cut-away view of one embodiment of a supply of shingled lenses within a package.
Figure 3A:
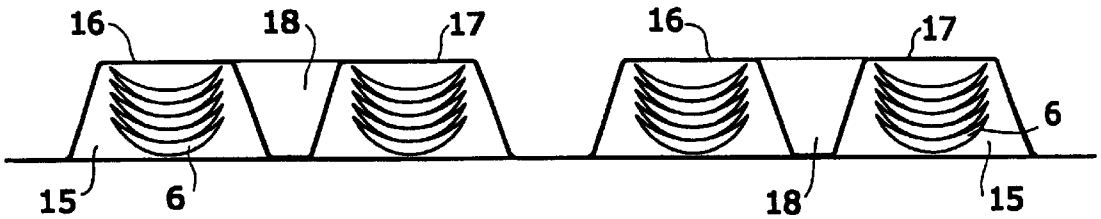
FIG. 3A is a cross-sectional view of another embodiment wherein the lenses are dry packaged in a blister-pack storage container.
Figure 3B:
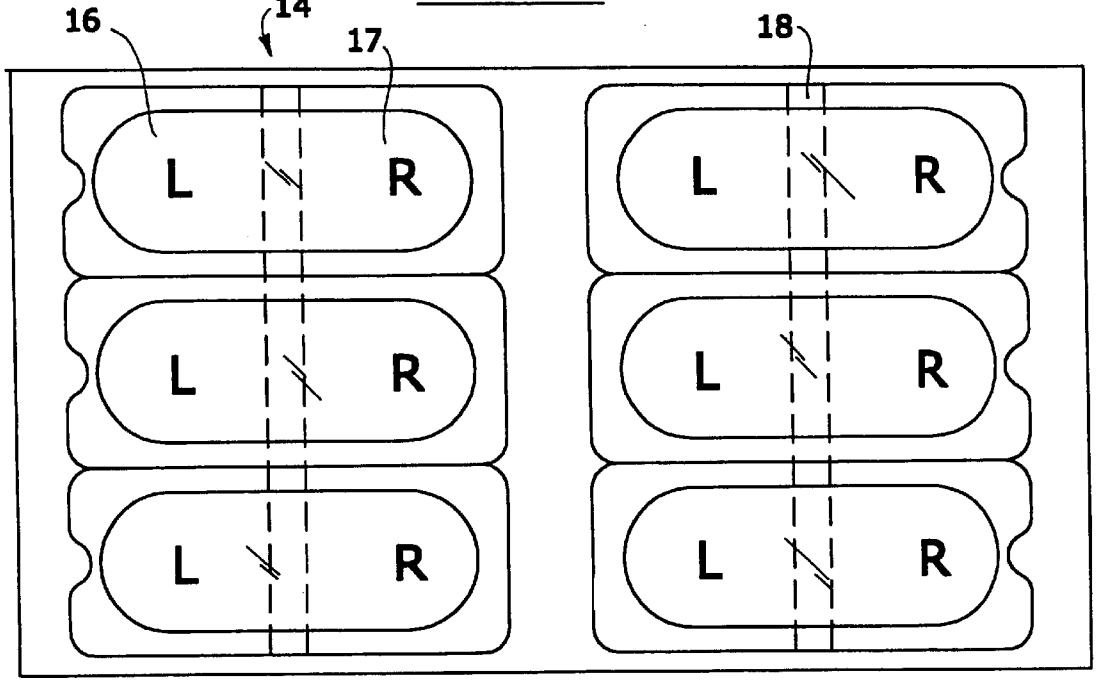
FIG. 3B is a top plan view of the blister pack storage container of FIG. 3A.
Figure 4:
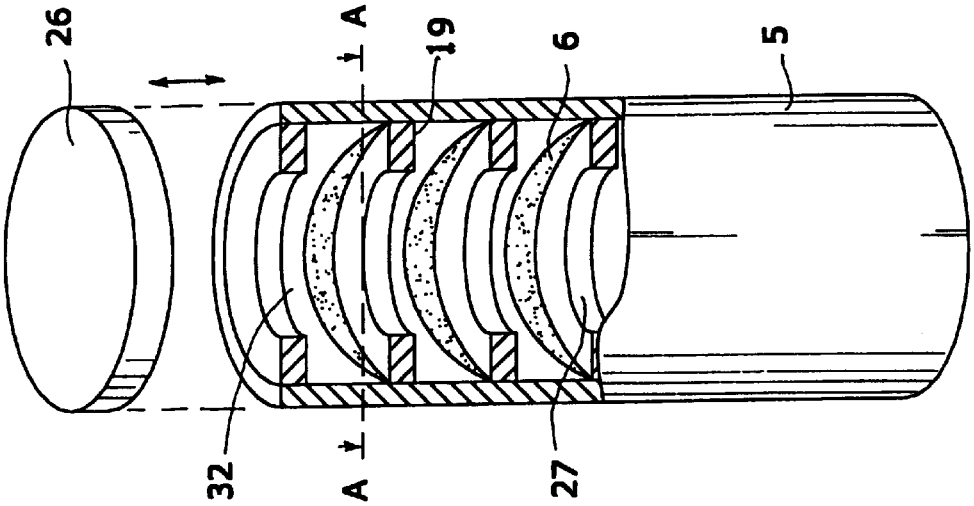
FIG. 4 is a partial cut-away view of one embodiment of a shelved storage container.

FIGS. 2, 3, and 4 depict other possible alternative embodiments of a packaging system. FIG. 2, in particular, shows the dry packaging of lenses 6 in a shingled configuration 11 as opposed to straight stacking of the lenses 6. When packaged in this manner, the lenses 6 are laid at an angle overlapping one another. Shingled lenses 11 can be packaged in various containers. However, a semi-cylindrical container 13 is ideal because it offers space efficiency and can minimize the movement of lenses 6 during distribution. The advantage of this configuration 11 is that the physical contact between lenses 6 is limited. Unlike stacked lenses 7, where there is significant physical contact. between lenses 6 in the absence of a separating material, shingled lenses 11 are only in contact at the regions 12 where they overlap. Because shingled lenses 11 have minimal physical contact, they are less likely to adhere to each other. In addition, a powder or comparable material, preferably a cyclodextrin 9, can be applied to further limit adherence at the contact regions 12. Alternatively, shingled lenses 11 could be packaged without a contact-limiting material in an evacuated and hermetically sealed container to inhibit adherence.

Referring now to the alternative embodiment of FIGS. 3A and 3B for packaging dry hydrogel lenses, a pre-arranged supply of lenses 6 is stored in a composite set of gas-impermeable blister-pack containers 14. Lenses 6 packaged in an individual blister-pack cavity 15 can be arranged in a variety of ways. For instance, one way to arrange the lenses 6 is to package the lenses 6 in small stacks or vertical columns. A plurality of separate blister cavities 15 can be integrally connected so that a sequentially connected right-hand series 17 of blister cavities 15, each holding a supply of right-eye lenses, can be packaged alongside a corresponding sequentially connected left-hand series 16 of blister cavities 15, each holding a supply of left-eye lenses, as shown in FIG. 3B. Each blister cavity 15 contains at least three unhydrated lenses 6. The depth of each cavity 15 can vary depending on the number of lenses 6 that the manufacturer wishes to package. The diameter of each cavity 15 can be configured so that it is only slightly larger than the diameter of the stored lenses 6 to prevent the lenses 6 from flipping over during storage and distribution. In addition, manufacturers can use a cyclodextrin powder or alternative contact-lens separating material to prevent the stored lenses 6 from adhering to each other; or each blister cavity 15 can be evacuated and hermetically sealed (as explained above) to limit adherence.

In the alternative embodiment of a packaging system of FIG. 4, the dry packaging of lenses 6 in cylindrical container 5 involves each lens being held on (when the container is vertically held) or between dividers 19. A flat cap 26 can be employed for opening and closing the container 5, as will be readily understood by the skilled artisan. FIGS. 5A, 5B, and 5C are cross-sectional views along line A—A of FIG. 4, of various embodiments of means for dividing and/or supporting contact lenses in the container of FIG. 4, including respectively an annular shelf 39, bars or prongs 40, and circular segments 41. Applicants prefer to form the shelved container 5 by molding first and second, mateable semi-cylinder parts (not shown). Each semi-cylinder part is molded to include interior dividers spaced equidistant from each other, running radially along the inner side-wall of the part, perpendicular to the central axis of the cylinder. The manufacturer can place a single unhydrated lens between shelves in one semi-cylinder part. Once all of the lenses are in place, the manufacturer can mate the second semi-cylinder part with the first semi-cylinder part to form a cylindrical storage container 5 wherein each stored lens 6 is supported by or between shelves or other dividers.

Regardless of the configuration of the storage container, various devices can be used to extract and dispense the stored unhydrated lenses. For example, in the embodiment of FIG. 6, a dispenser 20 comprises a moveable arm 21 including a suction head 22 to lift a lens or pair of lenses 6 from a stored array 7. This can be combined with a pump that provides a hydrating solution to a lens case in which the lens is dispersed. For example, Applicants envision one embodiment in which an open lens case can be inserted into an elongated slot in a dispensing system, whereby sequentially a hydrating solution is pumped into and a pair of lenses is dropped in the lens case. Alternatively, as shown in FIG. 7, the moveable arm 21 can also employ a wetted member 23 instead of, or in addition to, a suction device 22 to adhesively withdraw a contact lens from the lens stack 7. After extracting the desired top lenses, the arm 21 can be moved to a designated position where the lenses 6 can be dispensed for hydration and storage. The length of the vertical member 25 can be appropriately sized so that the dispenser can extract each lens 6 stored in the container 5, including those lenses 6 that are at the very bottom of the array, or the stack of lenses can be moved up in position, for example, as explained with reference to FIG. 8. It will be understood by the skilled artisan that the dispensing apparatus in FIGS. 6 and 7 can be suitably automated or, alternatively, can be manually accomplished to a greater or lesser extent, for example, by manually swinging the arm 21 from one side to the other and back again when dispensing each pair of lenses. Alternatively, it is possible for a contact-lens wearer to merely employ the tip of his or her index finger wetted with an ophthalmic solution to adhesively remove the top lens from a stack of lenses.

In yet another embodiment, shown in FIG. 7, the dispensing system comprises a dispenser arm 21 that includes a wetted member 23 and, instead of or in addition to a suction device 22, a rotating arm holder 24 that can be used to alter (in unison) the position of the stored array 7 and dispenser arm (see FIG. 7). Accordingly, a user can position the wetted member 23 of the dispenser means 21 slightly above the uppermost lens 6 in a stored vertical array 7. (Because the introduction of moisture can cause stored lenses 6 to adhere, it is important to limit the amount of solution applied to the wetted member 23.) Using the rotating holder 24, the user can then invert the array 7 so that the uppermost lens 6 comes into physical contact with the wetted member 23 of the dispenser which is now under the top lens. The array 7 can then be returned to its upright position, allowing the uppermost lens 6 to remain adhered to the wetted member 23 of the dispenser while the remaining supply of lenses 6 falls back to the bottom of the storage container 5. The user can then swivel the rotating arm of the dispenser to the left to release the extracted lenses for hydration and storage, for example, by a puff of air, a mechanical means of pushing the lens from the wetted member 23, and/or the action of gravity.

FIG. 8 shows still another embodiment of a dispensing device 33, a so-called "lipstick-style" dispenser. The lipstick-style dispensing device 33 comprises a cylindrical storage container 5 and a screw piston 36 to incrementally advance the stack of lenses towards the opening 32 of the storage container 5 by movement of the piston (for example, by screwing the end knob 35 which can be notched on the side to facilitate turning). By rotating the knob 35, a user can incrementally advance the threaded shaft 34 and the supporting shelf 36 toward the container opening 32. The incremental advancement of the supporting shelf 36 allows the user to dispense the lenses 6 from the container 5 one lens at a time. When the dispenser is not being used, the opening 32 can be closed using the cap 26 to minimize the introduction of moisture into the container 5. To prevent the lenses from adhering to each other, a cyclodextrin or alternative contact-limiting material is preferably used. Alternatively, or in addition, a lens can be adhesively removed from the top of such a stack of lenses by using the tip of the contact-lens wearer's index finger after wetting it in an ophthalmic solution, for example, the solution used to hydrate the lens.

Finally, FIG. 9 shows yet another embodiment of a dry contact-lens dispenser which uses a container such as depicted in FIG. 4 as a supply of lenses for the dispenser. This embodiment includes a storage container 5 with shelves 38 similar to those described with reference to the embodiment of FIG. 4. Each lens 6 in the container 5 is supported by a shelf 38. The shelf 38 can include various supporting structures (see FIGS. 5A to 5C); for instance, an annular ring or segment thereof, tabs, bars, etc. The dispenser 36 operates by inserting a hollow cylinder 37, having a diameter slightly smaller than the container 5, but slightly larger than the diameter of the lenses 6, into an open end of the container 5. As the cylinder 37 is progressively and slidably inserted into the concentric container 5, it engages the supporting structure(s) of each successive shelf 38 and bends the supporting structure(s) back so that the lens 6 becomes unsupported. As a result, the lens 6 enters the opening of the cylinder 37 and falls from the container 5 out through the open end 42 of cylinder 37. By inserting the cylinder 37 in incremental distances, a user can bend each supporting shelf 38 one by one and dispense the lenses 6 one at a time. To avoid breaking the shelves 38 during the insertion of the cylinder 37, Applicants prefer to mold each shelf 38 of a relatively flexible resin.

In reference to the dispensing mechanism of FIG. 9, a dispensing device can be designed for home use which can be used in combination with a package or container of contact lenses as depicted in FIG. 4. The container can be opened, inverted, and placed in the circular opening of a cylindrical slot in the dispenser housing, inside of which a hollow cylindrical tube 37 is positioned underneath the slot. The cylindrical tube 37 can then be incrementally pushed through the opening of the container 5 in a reverse telescoping movement, thereby bending each shelf 38 using only minimal force without damaging the lenses 6. This movement of the cylinder can be automated, for example, in combination with a knob that is turned or a button that is pressed. As mentioned above, manufacturers of the dispensing device can facilitate sequential advancement of the cylinder 37 and dispensing of each lens by making the shelves 38 rigid enough to support each lens 6 and yet sufficiently flexible to allow ease of bending, whereby each lens 6 is sequentially made to pass through the cylindrical tube 37 and out the opening 42 into a lens case (not shown) where it is hydrated. In another variation, the lens case can be placed in a horizontal slot in the dispensing device, which action is made to automatically cause or initiate the incremental movement of the cylinder 37 and the consequent dispensing of the lens into the lens case. As will be obvious, two containers 5, one for each eye can be simultaneously utilized in parallel.

As will be understood by the skilled designer, a dispensing unit according to the present invention can optionally include a lens counter to keep track of the number of lenses remaining to be dispensed. The unit can also have an indicator to inform when the hydration step is complete and the lenses are ready for insertion in the eyes. Still further, the unit can have an indicator to display the amount of solution left in the bottle used to hydrate the lenses. For example, the amount of solution left in the bottle can be determined by the number of times a dispensing pump was operated and the capacity of the bottle.

In view of the above, Applicants' dry packaging system for soft contact lenses offers many advantages that traditional packaging systems do not provide. For instance, by eliminating the need to autoclave lenses, Applicants' system makes it possible to minimize the time and expense associated with regulatory requirements typically imposed to ensure hydrated lens quality. In doing so, Applicants' system can avoid time-consuming regulatory delays and allow the product to reach the market faster.

Furthermore, since autoclaving is unnecessary when using Applicants' system, lens packaging can be made less robust. Conventional lens packaging must be made to withstand the high temperature and pressure of autoclaving. However, absent the extended exposure to heat and pressure, packaging can be made more consumer-friendly. As a result, consumers can benefit from packaging that is easier to open and less likely to inadvertently cause damage to stored lenses. Moreover, because the package will not be autoclaved, manufacturers no longer have to employ special printing techniques to label lens packaging. As a result, labeling costs are minimized and consumers can enjoy labels that include larger print and are easier to read.

Another significant advantage of Applicants' system is that it allows additional flexibility in lens manufacturing processes. For example, since Applicants' system has the ability to extend product shelf life, it can be used on a global basis to increase centralization of lens molding operations in combination with one or more final lens-processing facilities at remote locations. The dry lenses can be produced at a limited number of manufacturing facilities around the world and then transported to, or stored at various final processing facilities.

As described herein and regardless of the configuration chosen, Applicants' system for packaging and/or dispensing dry hydrogel contact lenses offers manufacturers a simplified and more cost-effective alternative to existing packaging and distribution methods. It is conducive to just-in-time manufacture of hydrated lenses when employing the invention to allow contact-lens manufacturers to separate the molding from the packaging operations. Applicants' system will not only benefit manufacturers, but will ease the supply and demand problems faced by doctors and other vendors of soft contact lenses.

While Applicants' invention has been described in conjunction with specific examples, the examples provided are only mere illustrations of potential embodiments. Accordingly, many alternatives, modifications, and variations will be apparent to those skilled in the art in light of the foregoing description; and it Is, therefore, intended that Applicants' description embrace all such alternatives, modifications, and variations that fall within the spirit and scope of the appended claims.

We claim:

1. A packaged contact lens system containing a plurality of at least three unhydrated hydrogel lenses and comprising a gas and liquid impermeable container housing a stacked array of unhydrated hydrogel lenses, at least one first lens being placed between a second and third lens to dispose an anterior surface of the first lens adjacent to a posterior surface of the second lens and a posterior surface of the first lens adjacent to an anterior surface of the third lens so that a line passing through the center of the first lens also passes through the center of the second and third lens, said unhydrated hydrogel lenses being commonly exposed to an internal atmosphere of the container; wherein a material or divider limits physical contact between lenses in the stack to prevent them from sticking together.

2. The system of claim 1, wherein the stacked array of lenses is either vertically or horizontally arranged in the container.

3. The system of claim 1, wherein the stacked array comprises 7 to 31 lenses.

4. The system of claim 1, wherein the container is cylindrical in shape and said line is substantially perpendicular to the face of the lens.

5. The system of claim 1, wherein the stack of contact lenses is shingled and said line is at an acute angle to the central axis of the lenses.

6. The system of claim 1, wherein physical contact between contact lenses is limited by a dry powder applied to surfaces of the stacked lenses.

7. The system of claim 1, wherein the particulate material is a powder that is water soluble, non-toxic, less hygroscopic than the lenses, and resistant to chemical or enzymatic attack.

8. The system of claim 7, wherein the powder is a cyclodextrin.

9. The system of claim 1, wherein physical contact between lenses is prevented or limited by a divider that is integrally molded to the inside wall of the container and supports the lens when the container is vertically positioned.

10. The system of claim 9, wherein the divider is a shelf comprising an annulus or portion thereof.

11. The system of claim 1, wherein the container is a gas-impermeable plastic blister-pack container and comprises a removable lid.

12. A container and dispensing system for unhydrated hydrogel contact lenses comprising (a) at least one container housing a stacked array of unhydrated hydrogel contact lenses, wherein at least one first lens is placed between two adjacent lenses, one on each side of the first lens, said unhydrated hydrogel lenses being commonly exposed to an internal atmosphere of the container, wherein a material or divider prevents or decreases physical contact between lenses in the stack to prevent them from sticking together, and (b) a dispenser for removing the contact lens from its container or for removing a pair of contact lenses from their containers for hydration in a lens case.

13. The system of claim 12, wherein the dispenser device employs suction to lift each lens or pair of lenses one at a time from the stacked array of lenses.

14. The system of claim 12, wherein the dispenser is capable of rotating the stacked array of lenses, so that when inverted a lens is brought to the opening of the container for withdrawal and, in its upright position, the uppermost lens can be lifted from the container.

15. The system of claim 14, wherein the dispenser includes a wetted member.

16. The system of claim 12, wherein the dispensing device employs gravity to dispense each lens or a pair of lenses.

17. The system of claim 12, wherein the dispensing device uses a puff of air to dispense each lens or pair of lenses.

18. The system of claim 13, wherein the container comprises dividers supporting each lens and the dispensing device sequentially bends each divider holding a lens in the stacked array so that each lens or pair of lenses falls one at a time out of the container.

19. The system of claim 12, wherein the dispensing device drops each lens or pair of lenses one at a time into a lens holder or lens case where the lenses can be hydrated and stored.

20. The system of claim 12, wherein the lenses are sequentially moved to an open end of the container by a screw piston.

21. The system of claim 12, wherein the dispenser also comprises a pump for providing hydrating solution to a lens case.

22. The system of claim 12, wherein the dispensing device includes a hollow cylinder that bends each successive supporting shelf causing the supported lens to fall from the container out through an open end of the inserted cylinder into a lens case.

23. A method of storing soft hydrogel contact lenses in an unhydrated state comprising:

a. stacking a supply of unhydrated hydrogel lenses in a gas and liquid impermeable container so that at least one first lens is adjacent two other lenses, one on each side of the first lens, wherein said hydrogel lenses are commonly exposed to an internal atmosphere within the container; and b. preventing the stacked lenses from sticking together by either preventing or limiting physical contact between lenses in the stack or by maintaining a vacuum and/or an inert atmosphere within the container until all lenses are removed from the container.

24. The method of claim 23, including designing and labeling the container for consumer use.

25. The method of claim 23, including using the container to store lenses prior to hydration in a contact lens processing and packaging plant.

26. The method of claim 23, including stacking the lenses in a nested array so that an anterior surface of one lens is adjacent to a posterior surface of an adjacent lens.

27. The method of claim 23, including forming a stacked array of lenses comprising 7 to 31 lenses.

28. The method of claim 23, including selecting a container that is cylindrical in shape.

29. The method of claim 23, including minimizing physical contact between contact lenses by applying a contact-limiting material or divider between the lenses.

30. The method of claim 29, including applying a dry powder to surfaces of the lenses to minimize physical contact to prevent the lenses from sticking together.

31. The method of claim 30, including selecting a powder that is water-soluble, non-toxic, less hygroscopic than the lenses, and resistant to chemical and enzymatic attack.

32. The method of claim 31, including selecting a cyclodextrin for the powder.

33. The method of claim 23, including limiting physical contact between the contact lenses by providing a shelf between lenses.

34. The method of claim 33, including configuring the shelf so that it forms an annular ring or portion thereof.

35. The method of claim 23, including using a gas-impermeable blister-pack container in which to store the lenses.

36. A method of packaging and dispensing contact lenses comprising:

(a) arranging a supply of unhydrated hydrogel lenses in a stacked array inside a gas and liquid impermeable container, housing at least one first lens placed between two adjacent lenses, one on each side of the first lens, wherein said hydrogel lenses are commonly exposed to an atmosphere within the container;

(b) preventing the stacked lenses from sticking together by preventing or limiting physical contact between lenses in the stack; and c. dispensing the contact lenses from the container one lens or one pair of lenses at a time.

37. The method of claim 36, including using suction to lift each lens or pair of lenses one at a time from the stacked array of lenses.

38. The method of claim 36, including dispensing each lens or pair of lenses one at a time by using gravity to make each lens or pair of lenses fall from the stacked array of lenses in the container.

39. The method of claim 36, including bending a shelf holding each lens in a vertical array so that each lens or pair of lenses falls from the container one at a time.

40. The method of claim 36, including dispensing each lens or pair of lenses from the container one at a time into a lens holder or lens case where the lenses can be hydrated and stored.

41. The method of claim 36, including sequentially moving the lenses to the opening of the container using a screw piston so that the lenses can be dispensed one at a time.

42. The method of claim 36, including using a pump to provide solution to a lens case for hydration of the dispensed lens.

43. The method of claim 36, including inserting a hollow cylinder into an open end of a storage container having dividers supporting stored lenses so that the inserted cylinder incrementally bends the supporting dividers one at a time allowing each successive supported lens to fall from the container out through an open end of the inserted hollow cylinder and into a lens case for hydration.

44. The method of claim 36, including lifting each lens one at a time from the container by inverting the container so that the uppermost lens of a stack is placed in contact with a lens-binding member of a dispensing device and then returning the container to an upright position so that the lens can be lifted out of the container.

* * * * *